US009136643B2

(12) United States Patent
Behning

(10) Patent No.: US 9,136,643 B2
(45) Date of Patent: Sep. 15, 2015

(54) CONNECTOR DEVICE

(71) Applicant: Christian Behning, Plymouth, MA (US)

(72) Inventor: Christian Behning, Plymouth, MA (US)

(73) Assignee: DG INTERCONNECTS, Kingston, MA (US)

( * ) Notice: Subject to any disclaimer, the term of this patent is extended or adjusted under 35 U.S.C. 154(b) by 39 days.

(21) Appl. No.: 14/172,523

(22) Filed: Feb. 4, 2014

(65) Prior Publication Data

US 2015/0222050 A1 Aug. 6, 2015

(51) Int. Cl.
*H01R 13/213* (2006.01)
*H01R 13/625* (2006.01)
*H01R 24/66* (2011.01)

(52) U.S. Cl.
CPC ..... *H01R 13/625* (2013.01); *H01R 24/66* (2013.01)

(58) Field of Classification Search
CPC ..... H01R 13/625; H01R 13/641
USPC ..... 439/299–315, 319, 296
See application file for complete search history.

(56) References Cited

U.S. PATENT DOCUMENTS

| | | | | |
|---|---|---|---|---|
| 3,402,379 | A | 9/1968 | Amis, Jr. et al. | |
| 4,285,564 | A * | 8/1981 | Spinner | 439/321 |
| 4,629,272 | A * | 12/1986 | Mattingly et al. | 439/318 |
| 4,762,504 | A * | 8/1988 | Michaels et al. | 439/345 |
| 4,820,185 | A * | 4/1989 | Moulin | 439/321 |
| 5,067,909 | A | 11/1991 | Behning | |
| 5,167,522 | A * | 12/1992 | Behning | 439/315 |
| 5,276,752 | A * | 1/1994 | Gugelmeyer et al. | 385/69 |
| 5,662,488 | A | 9/1997 | Alden | |
| 5,707,252 | A * | 1/1998 | Meszaros | 439/320 |
| 6,010,348 | A * | 1/2000 | Alden | 439/274 |
| 6,361,348 | B1 | 3/2002 | Hall et al. | |
| 6,517,373 | B2 | 2/2003 | Finke et al. | |
| 6,666,726 | B2 | 12/2003 | Koch | |
| 6,776,638 | B2 | 8/2004 | Thurston | |
| 6,851,958 | B1 | 2/2005 | Rowland et al. | |
| 7,081,001 | B1 * | 7/2006 | Conroy et al. | 439/314 |
| 7,086,886 | B2 | 8/2006 | Thurston et al. | |
| 7,326,091 | B2 * | 2/2008 | Nania et al. | 439/681 |
| 7,568,934 | B1 | 8/2009 | Williams et al. | |
| 2004/0106320 | A1 | 6/2004 | Collin et al. | |
| 2005/0064752 | A1 * | 3/2005 | Serino | 439/320 |
| 2007/0275590 | A1 * | 11/2007 | Cheng | 439/404 |
| 2012/0329323 | A1 | 12/2012 | Fink et al. | |
| 2014/0065874 | A1 * | 3/2014 | Ledgerwood et al. | 439/489 |

FOREIGN PATENT DOCUMENTS

| | | |
|---|---|---|
| EP | 0140628 | 5/1985 |
| WO | 2010081129 | 7/2010 |

OTHER PUBLICATIONS

Stefanie Schmid, Compona präsentiert: Binder NCC Steckverbinder Serie 770, http://www.youtube.com/watch?v=03pOKmZVFtM, viewed Feb. 19, 2014, posted Jan. 7, 2013.

* cited by examiner

*Primary Examiner* — Briggitte R Hammond
(74) *Attorney, Agent, or Firm* — Lambert & Associates; Gary E. Lambert; David J. Connaughton, Jr.

(57) ABSTRACT

Electrical connector systems and devices are provided. Included are push-push electrical connectors, as well as push-twist electrical connectors. These electrical connectors are configured to be user friendly, space efficient, and safe.

20 Claims, 7 Drawing Sheets

CONNECTOR DEVICE

BACKGROUND OF THE INVENTION

1. Field of the Invention

The present invention relates generally to a connector device. More particularly, the present invention relates to a push-on/push-off connector allowing the connector to be secured and removed by a pushing motion.

2. Description of Related Art

With telescopically mating electrical connectors such as a plug and a socket it is often desirable or necessary to lock the two connector bodies together after their conductive contacts have been physically and electrically joined. Single conductor connectors with some form of bayonet joint may be rotated to a locking position. Multiple male and female contacts, however, must be slidingly joined telescopically without rotation, and typically have used a pliable plastic connector body which is deformed as a catch on one connector body rides over a detent on the other connector body to a locking position beyond the detent. If such a deforming latching body is frequently engaged and disengaged the plastic fatigues from the deformation and the latching mechanism fails. Some electrical connectors with push to connect-twist to remove (referred to herein as a push-twist connector), twist to connect/twist to remove, and push to connect-pull to remove (push-pull connector) features have been developed, however they are bulky and inefficient.

Therefore, what is needed are electrical connector devices that may be space-efficient and operate on an enhanced push to connect-twist to remove or new push to connect-push to remove (push-push) attachment-removal mechanism.

SUMMARY OF THE INVENTION

The subject matter of this application may involve, in some cases, interrelated products, alternative solutions to a particular problem, and/or a plurality of different uses of a single system or article.

In one aspect, an electronic connector system comprising a plug and a receptacle is provided. The plug comprises a plug housing defining a body of the plug, and a connector end extending from the plug housing with an electric contact positioned within. A plurality of plug drive tabs having canted leading faces extend from the plug housing. A substantially cylindrical coupling ring is rotatably attached to the plug. The coupling ring comprises a plurality of ring drive tabs having a canted front surface, and a plurality of latch tabs having a canted leading face and a canted trailing face. The drive tabs and latch tabs are on opposite ends of the cylinder.

The receptacle of the electronics connector system comprises a receptacle body defining a slot for receiving the plug, with a second electric contact within the slot configured to connect to the first electrical contact of the plug. The receptacle further comprises a plurality of receptacle tabs connected to the receptacle body. The receptacle tabs are configured to receive the latch tabs of the coupling ring. The receptacle tabs may be configured in any manner, but typically they will extend into the slot from the receptacle surface.

This aspect of the electronics connector system is configured such that upon a first inward pushing motion of the plug towards the receptacle, the plurality of latch tabs are received by the plurality of receptacle tabs, thereby connecting the plug within the receptacle and connecting the first and second electric contacts. Further, upon a second inward pushing motion of the plug when the plurality of latch tabs are received by the plurality of receptacle tabs, the plurality of latch tabs, and in turn the plug, are released from the plurality of receptacle tabs. In some embodiments, a spring may further provide an axial force to eject the plug from the receptacle.

In another aspect, an electrical connector is provided. The electrical connector comprises a first and second tubular connector bodies having telescopingly engagable body portions and axial mating electrical contacts. The electronic connector further comprises an annular collar rotatably held on the first body, which is sized to fit within a cavity formed by the second body. A spring is connected to the collar, the ends of the spring being between the first body and the collar, and the spring is configured to yieldingly resist rotation of the collar. The electrical connector has at least two axially opposed tabs. A first tab is on an outer surface of the annular collar. A second tab is on an inner surface of the cavity formed by the second body. The tabs are configured with opposing flaring cam surfaces that cooperatively produce rotation of the collar relative to the second body when the bodies are telescoped to a mated contact position. Thus, the cam surfaces guide the first tab around the second tab. This electric connector is configured such that the spring yields as the collar is rotated by the cam tabs during contact mating, and then the spring can rotate the first tab to a latching position axially behind the second tab, locking the connector bodies in a mated contact position. Further, a circumferential ramp extends from an outer surface of the annular collar. The circumferential ramp is configured to be guided by the second tab upon manual axial rotation of the collar relative to the second body when the two are mated together. The guiding of the circumferential ramp by the second tab urges the collar out of the receptacle cavity, thus facilitating removal of the first body from the second body. Depending on embodiment, a spring may provide an axial force urging the plug out of the receptacle, thereby at least partially eliminating the need for the ramp.

DETAILED DESCRIPTION

Figure 1:
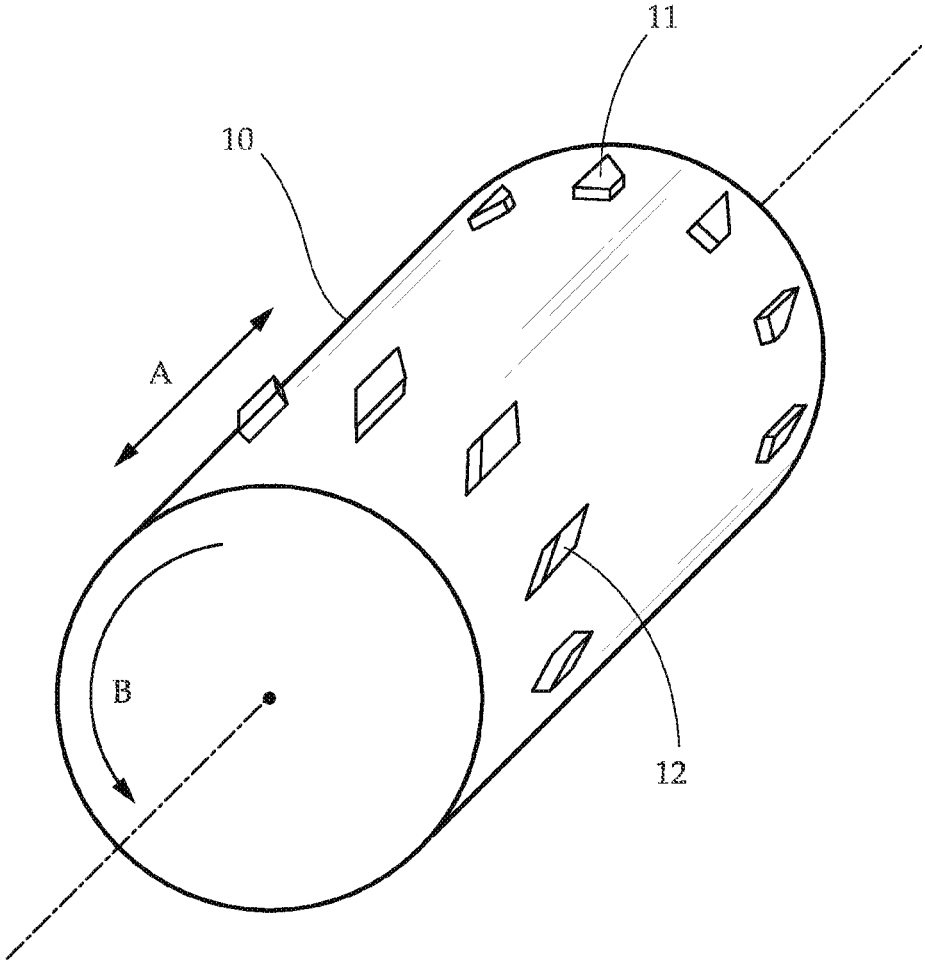
FIG. 1 provides a perspective view of an embodiment of a coupling ring of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, one aspect of the present invention concerns connector, such as an electrical connector, that is engaged and disengaged by an inward pushing movement. Another aspect of the present invention concerns a connector, such as an electrical connector, that is engaged by a pushing motion and disengaged by a twisting motion. The present invention may be used for any connection, though it is particularly applicable to electrical connection of a plug to a receptacle. Particular embodiments of the connector include electronic connections to an interface panel, for example on a medical instrument, instrumentation paneling, and the like. The push-push and push-twist connector devices are configured to provide a safe, user friendly, and efficient way to connect structures, particularly electronics. The efficient structure of the push-push and push-twist connector devices allows for maximizing connections per plug, making them easily adaptable for advanced electronics connections. While the present invention is generally described in use as an electronics connector, it should be understood that the connector invention may work equally well as a pneumatics connector, hydraulic connector, hybrid connectors (containing multiple elements such as electronics, pneumatics and/or hydraulic), and the like.

In one embodiment, multiple electronic devices such as measurement devices could all be connected to an interface panel, the interface panel being configured to receive the multiple inputs and provide an output. This application may be particularly useful in medical device field. For example, a monitoring device may be configured to receive a plurality of inputs on an interface panel, and provide monitoring output such as a visual display output or data recording output. A number of medical devices may be attached to one or more patients, each device having an electric signal output with an electrical connector described herein at an end of an electric cable to be attached to the monitoring device. These medical devices may be easily connected to the monitoring device using the push-push connector structure, or push-twist structure, providing a safe, user-friendly and reliable electronic connection of the medical device to the monitoring device.

In another embodiment, different electrical connections providing different aspects of therapy and/or control for a device may be contained in the connector plug, providing multiple functions to the cord connection. For example, in one embodiment the plug may be used on a defibrillator device, the electrical connection providing the charge (therapy) and also sensor detecting heart activity (control) may be connected between paddles and device in the same cable using the connectors described herein.

The structure of the push-push connector device may be any structure capable of securely receiving a plug upon a first insertion, and substantially limiting removal until a second pushing depresses the plug slightly further, releasing it for removal. The embodiments described herein teach some such structures, however other embodiments allowing this operation are within the scope of the present invention.

The structure of the push-twist connector device may be any structure capable of securely receiving a plug upon a first insertion, and substantially limiting removal until a twisting motion disengages and releases the plug. The embodiments described herein teach some such structures, however other embodiments allowing this operation are within the scope of the present invention.

Turning now to FIG. 1, a view of an embodiment of a coupling ring of the push-push connector device is provided. The coupling ring is configured to engage both the plug and receptacle, and facilitates the locking and release of the plug in response to an inward pushing motion of the plug. The coupling ring 10 may be attached to either the plug or receptacle, depending on embodiment. Coupling ring 10 is substantially cylindrically shaped and may have a hollow center. It should be understood however, that the coupling ring 10 may be any shape and structure that allows it to operate as described herein. The coupling ring 10 has ring drive tabs 11 protruding from an outer surface of the coupling ring 10, though in alternative embodiments they may protrude from an inner surface of the coupling ring 10 without straying from the scope of this invention. The ring drive tabs 11 are configured having a canted leading edge near a first end of the coupling ring 10. The canted leading edge of the ring drive tabs 11 are configured to engage with a drive tab on the plug (not shown). However, it should be understood that the ring drive tabs may be configured to engage with a drive tab on the receptacle if the device were reversed.

Latch tabs 12 protrude from an outer surface of the coupling ring 10, though in alternative embodiments they may protrude from an inner surface of the coupling ring 10. The latch tabs 12 have canted leading and trailing sides facing toward and away from a nearby edge of the coupling ring 10. These canted leading and trailing sides facilitate engagement and rotation with latch tabs (not shown) of the receptacle or plug, depending on embodiment.

Figure 2:
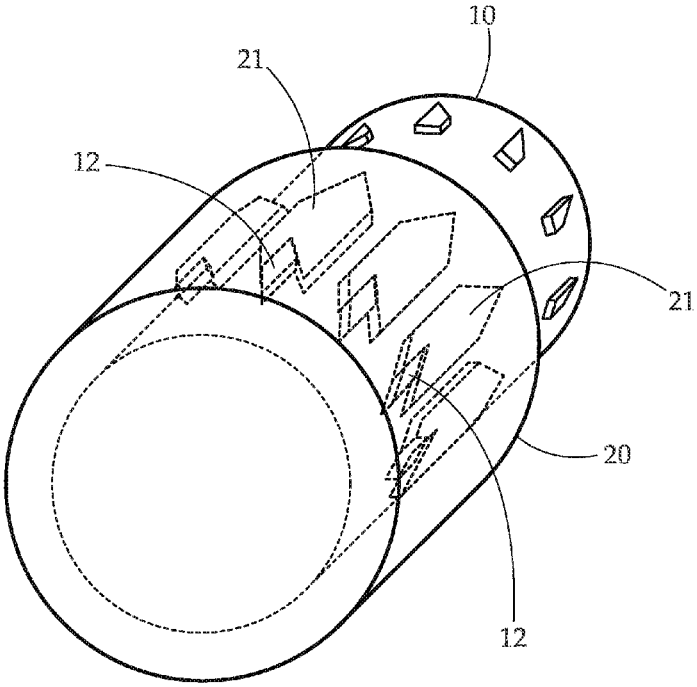
FIG. 2 provides a perspective view of another embodiment of a coupling ring of the present invention.

FIG. 2 shows an embodiment of a coupling ring engaging a receptacle. The coupling ring 10 can be seen partially positioned within receptacle 20. In many embodiments, the receptacle and coupling ring may be concentric. Depending on embodiment and coupling ring 10 tab configuration, the coupling ring 10 may fit within the receptacle 20 or alternatively, the receptacle 20 may fit within the coupling ring 10.

Receptacle tabs 21 are shown receiving latch tabs 12. In one embodiment, the coupling ring 10 is in communication with a spring or other device capable of providing a force (collectively referred to herein as a spring). This spring (not shown) is configured to urge the coupling ring 10 away from the receptacle 20 along the longitudinal axis of the coupling ring 10. The spring (not shown) and drive tabs 31. 11 urge the latch tab into a notch formed by the receptacle tabs 21, where the latch tabs 12 are shown secured in this figure. Operation of the mechanism is discussed further with respect to FIGS. 4-6, below. It should be understood that the orientation of tabs may be reversed, allowing the receptacle tabs 21 to be positioned on a plug housing.

Figure 3:
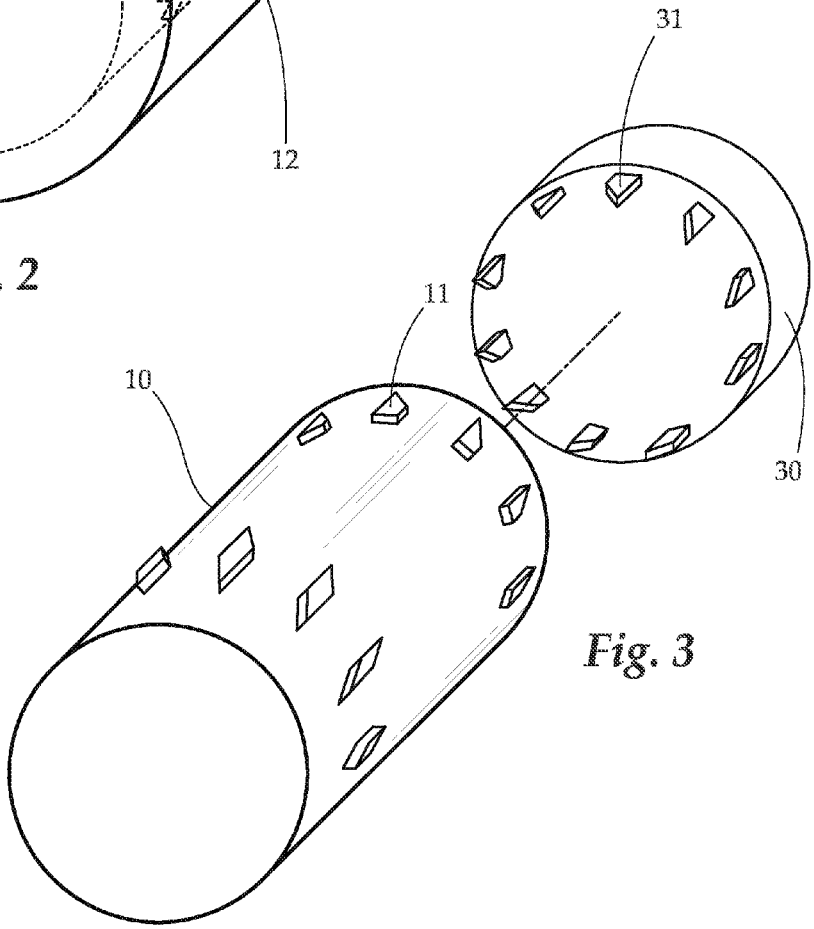
FIG. 3 provides a perspective view of another embodiment of a coupling ring of the present invention.

FIG. 3 shows an embodiment of a coupling ring configured for interacting with a plug housing elements. The plug housing (also referred to as a plug drive housing) 30 has a quantity of plug drive tabs 31 extending from a front face. These tabs are canted at an angle capable of mating with the canted face of the ring drive tabs 11. The plug housing 30 and coupling ring 10 are shown here to be concentrically aligned, both having a generally circular cross section. In many embodiments, the coupling ring will be rotatably connected to the plug. Upon engagement of the plug drive tab 31 and ring drive tab 11, the plug housing 30 will be able to urge the ring in a forward motion along its longitudinal axis, and also, by way of the engaging canted faces, urge the coupling ring in a rotational direction about its longitudinal axis. In the embodiment shown, the ring would be urged counter clockwise, though it should be understood that the direction of the canted faces could urge rotation in either clockwise our counter clockwise directions. Upon engagement of the coupling ring 10 with the receptacle housing 20 and receptacle tabs 21, the latch tabs 12 of the coupling ring 10 will limit rotational motion during certain ranges of longitudinal motion, and thus the coupling ring will only be allowed to rotate when in a position such that the latch tabs 12 are free from engagement with the receptacle tabs 21. Regardless of the arrangement of ring drive tabs 11 and if they are on the outside or inside of the coupling ring 10, the plug drive tabs 31 may be radially positioned along the plug housing to engage with the ring drive tabs 11.

Figure 6:
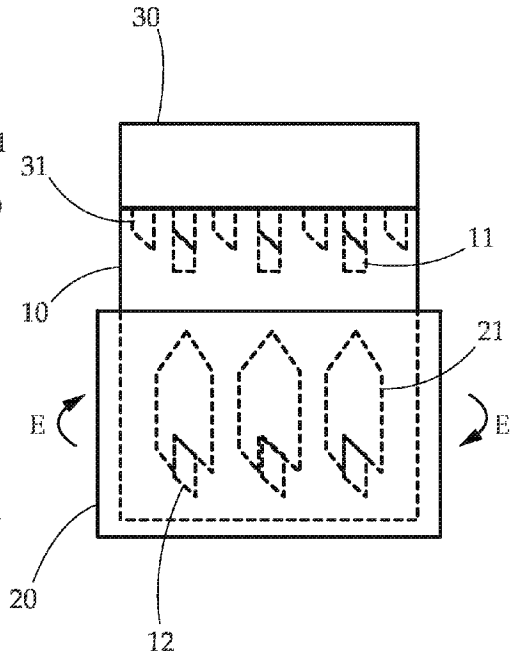
FIG. 6 provides a plan view of another embodiment of the connector.
Figure 5:
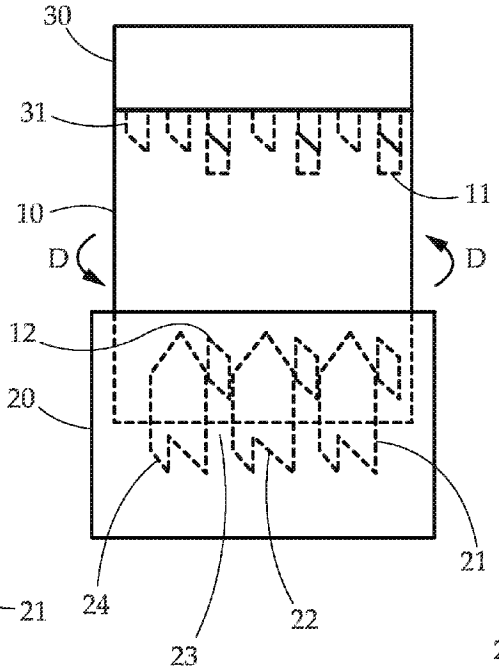
FIG. 5 provides a plan view of another embodiment of the connector.
Figure 4:
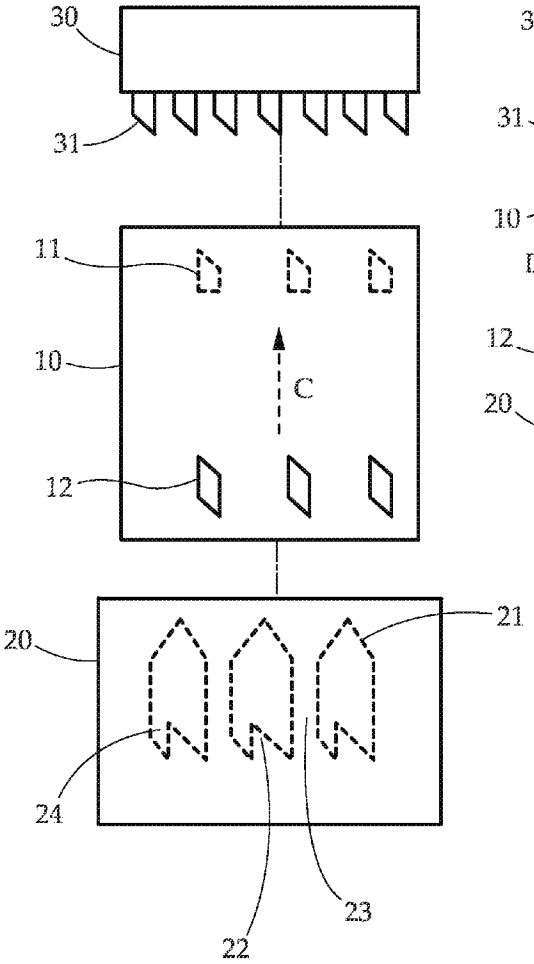
FIG. 4 provides a plan view of another embodiment of the connector.

FIGS. 4-6 provide views of the plug, coupling ring, and receptacle in varying stages of connection and operation. FIG. 4 shows the elements at rest with the ring floating and randomly located. In some embodiments, at some stage before or during insertion of the plug, the coupling ring is biased away from the receptacle housing 20 by a spring or other force (not shown), this bias is shown as direction C. The ring drive tabs 11 and latch tabs 12 are not at this point aligned with the plug drive tabs 31 or receptacle tabs 21.

FIG. 4 provides a view of the receptacle tabs and an embodiment of their shape. It should be understood that the receptacle tabs may be any shape allowing for a push-push connection-disconnection function. In this embodiment, the receptacle tabs 21 have a pointed leading edge, the sides joining at a centerline and having identical or nearly identical sides sloping away. The receptacle tabs have a middle portion with straight sides extending towards a rear portion. When aligned, these straight edges form straight channels between each receptacle tab 21. These channels preferably will be large enough to allow passage of latch tabs 12. On a rear, trailing edge, the receptacle tabs 21 form two parts. The first part is an inwardly angled region on the trailing edge that forms a rear slot 22. This inwardly angled region may have an angle configured to substantially match the canted angle of latch tab 12 trailing edge. The rear slot 22 is sized and configured to receive at least a portion of the latch tab. The other portion of the trailing edge of the receptacle tab 12 is rear guide 24. The rear guide 24 extends away from the rear of the receptacle tab as a straight edge on the rear slot. An angled face at a similar or same angle to the angled rear slot joins to a straight side of the receptacle tab.

Upon a user pushing the plug inward, the plug housing 30 and plug drive tabs 31 engage the coupling ring 10. At this point, the latch tabs 12 are guided by the canting on their leading face and the angled canting of the front of the receptacle tabs 21 to align with channels 23 between the receptacle tabs 21. The plug drive tabs 31, ring drive tabs 11, latch tabs 12, and receptacle tabs 21 may be configured so that when the latch tabs 12 are aligned with the channel 23, the plug drive tabs and ring drive tabs will be aligned as well. This alignment is achieved by a rotation of the coupling ring 10 about its longitudinal axis, shown as direction D. In this embodiment, rotational direction D may be a clockwise rotation. This downward movement is achieved against the force of the spring or similar device urging the coupling ring away from the receptacle as shown in FIG. 4, direction C.

FIG. 5 provides a view of the plug structure in an engaging position. Once the plug has been pushed to the point that coupling ring 10 has been displaced to the point that its latch tabs 12 extend beyond channel 23, the coupling ring 10 is rotatable about the longitudinal axis in direction E. In this embodiment, rotational direction E may be a counter clockwise rotation. This rotation is achieved by a rotational urging caused by the canted engagement of the ring drive tab 11 and plug drive tab 31. The rotation is further aided, once the inward pushing force of the plug housing 30 is removed, by an upward urging of the spring (not shown) of the coupling ring 10 in direction C (see FIG. 4) coupled with the canting of the trailing edge of the latch tab 12 and matching canting of the rear slot 22 formed by the receptacle tabs 21. Thus, it can be seen that the structure shown allows for the free coupling ring to be aligned automatically with the latching structure regardless of its starting orientation.

In an embodiment such as that shown in FIGS. 4-6, the spacing between the plug drive tabs may ensure that the coupling ring 10 does not become over-rotated and miss the rear slot 22 of the receptacle tab 21, because the urging of the coupling ring in direction C, coupled with the canting rotation and slipping between the plug drive tabs 31 and ring drive tabs 11, cause the coupling ring to twist and move upwards, catching the latch tab 12 in rear slot 22. The latch tab 12 and rear slot 22 are configured such that when secured together, the ring drive tabs 11 are aligned with plug drive tabs 31.

Once the coupling ring 10 is received by the receptacle housing via the latch tabs 12 and receptacle tabs 21, the plug and corresponding connections will be secured to the receptacle. To remove the plug, a user must again push the plug housing 30 inward. Here, the plug will displace the coupling ring downwards until the latch tabs 12 extend past rear guide 24 of the latch tabs 21. Once the latch tab 12 moves past the rear guide 24, again the coupling ring may rotate based on by a rotational urging caused by the canted engagement of the ring drive tab 11 and plug drive tab 31. The rotation may be further aided, once the inward pushing force of the plug housing 30 is removed, by an upward urging of the spring (not shown) of the coupling ring 10 in direction C (see FIG. 4) coupled with the canting of the trailing edge of the rear guide 24 and matching canting of the latch tab 12 trailing face. The latch tabs are rotated and urged upward again into channels 23, at which point the coupling ring 10 and plug housing 30 are free to slide longitudinally away from the receptacle housing 20, thereby releasing the plug. As noted before, it should be understood that the mechanism could be reversed, with the latch tab structure being on the plug end, instead of the receptacle end, without straying from the invention contemplated herein.

Figure 9:
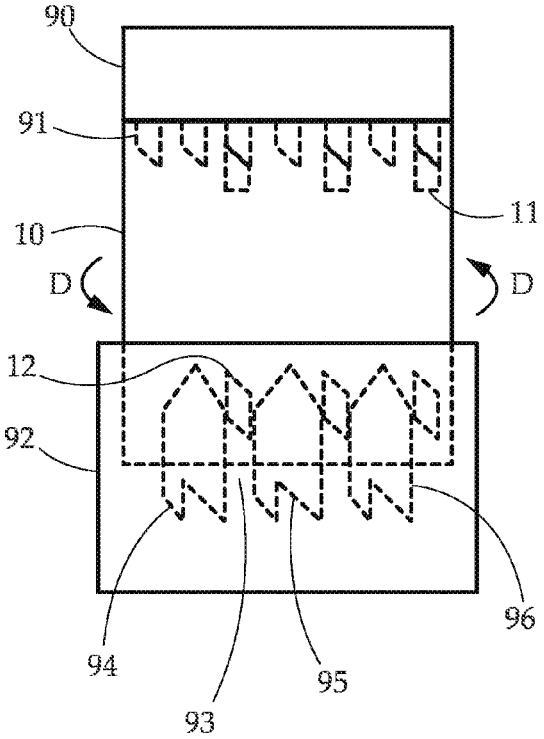
FIG. 9 provides a plan view of another embodiment of the connector.
Figure 10:
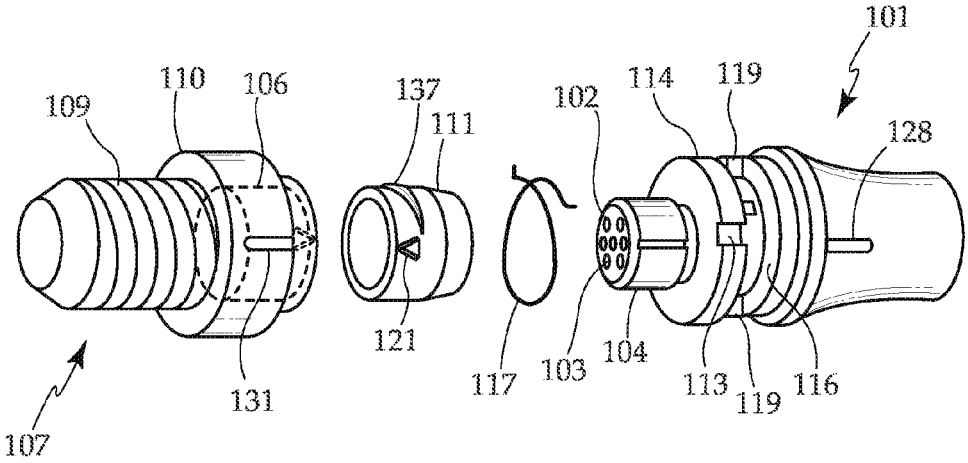
FIG. 10 provides an exploded view of another embodiment of an electrical connector.
Figure 11:
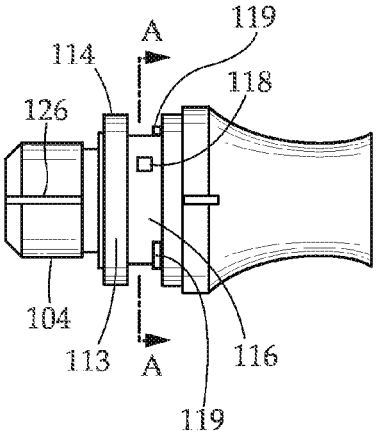
FIG. 11 provides a view of an embodiment of a plug component of an electrical connector.
Figure 12:
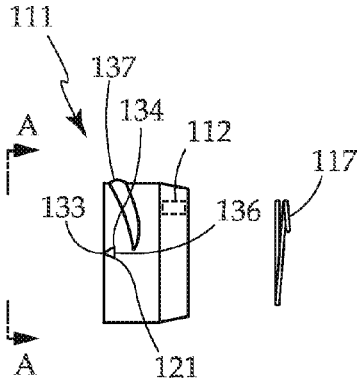
FIG. 12 provides a view of an embodiment of a collar component of an electrical connector.
Figure 13:
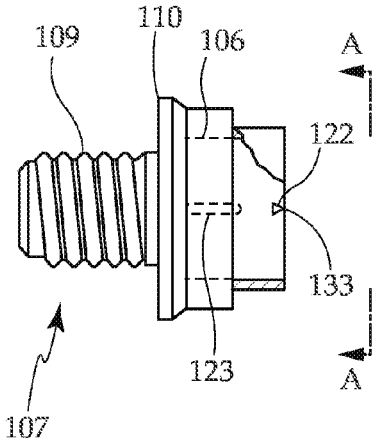
FIG. 13 provides a view of an embodiment of a receptacle component of an electrical connector.
Figure 14:
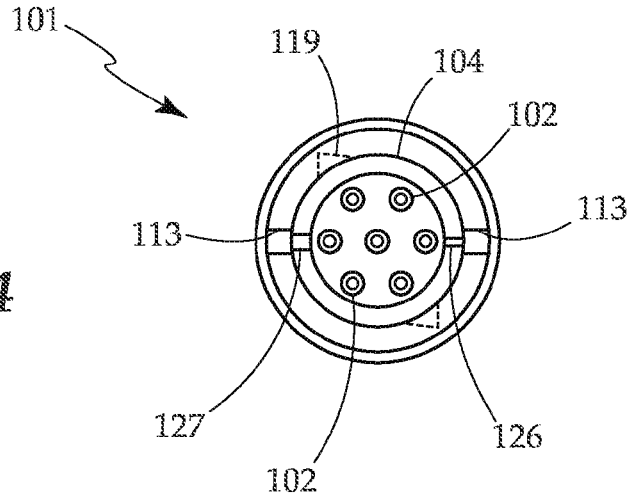
FIG. 14 provides an elevation view of an embodiment of a plug component of an electrical connector.
Figure 15:
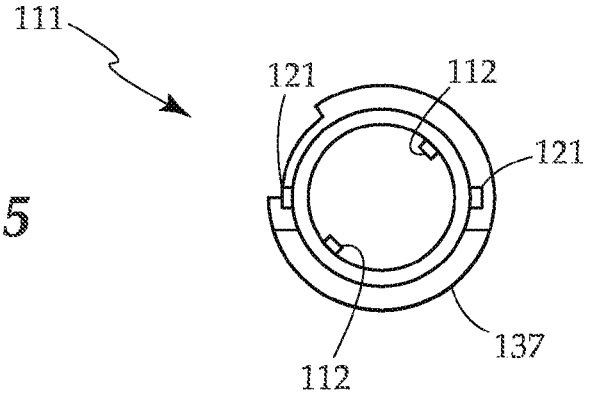
FIG. 15 provides an elevation view of an embodiment of a collar component of an electrical connector.
Figure 16:
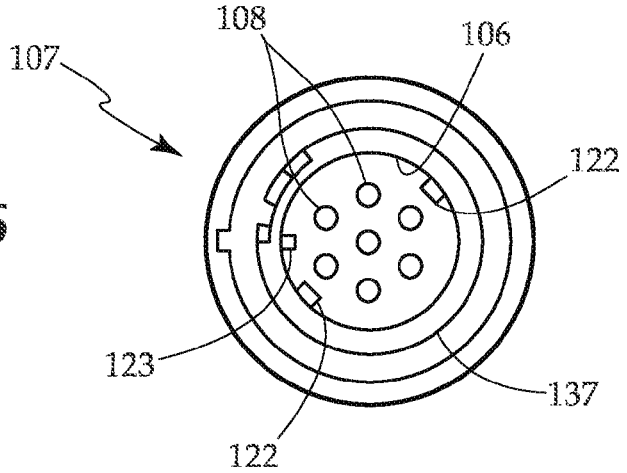
FIG. 16 provides an elevation view of an embodiment of a receptacle component of an electrical connector.

An alternative embodiment is shown in FIG. 9. FIG. 9 provides a view of the plug structure in an engaging position, with the drive tabs 91 being located on the receptacle 90, and the receiving tabs 96 being located on the plug 92. In this embodiment, the coupling ring 10 will be secured within the receptacle 90. Once the plug 92 has been pushed to the point that coupling ring 10 has been displaced such that its latch tabs 12 extend into channel 93, the coupling ring 10 is rotatable about the longitudinal axis in direction D. Latch tabs 12 are configured to be secured in rear slot 95 when secured, and upon a second pushing motion, the latch tabs 12 will be guided by rear guide 94 out of the slot 95 and into channel 93. Operation of this embodiment will be similar to that of FIGS. 4-6, except reversed. Thus, it can be seen that the structure shown allows for the free coupling ring to be aligned automatically with the latching structure regardless of its starting orientation.

Figure 7:
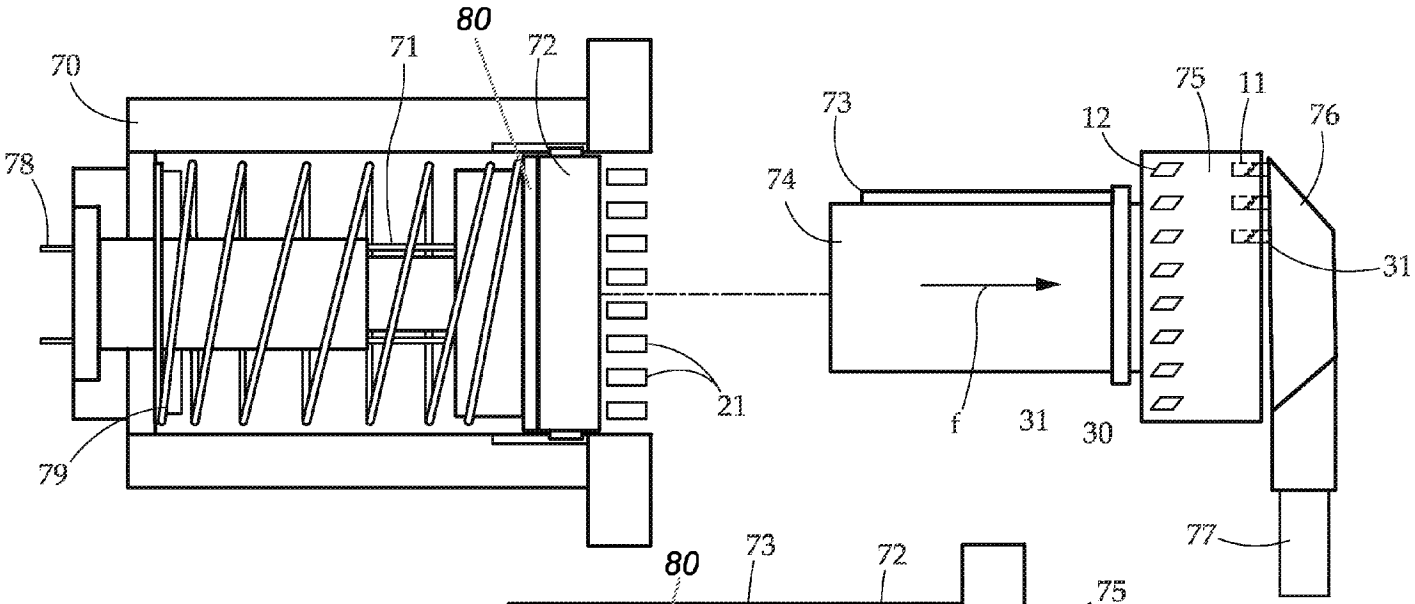
FIG. 7 provides a side cutaway view of an embodiment of a plug and receptacle utilizing the connection device.
Figure 8:
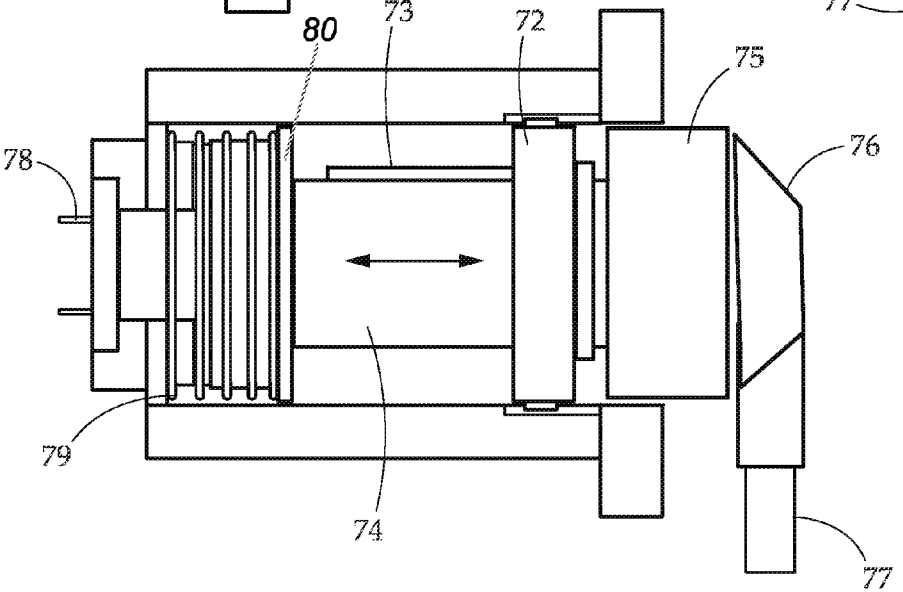
FIG. 8 provides a side cutaway view of an embodiment of a plug and receptacle utilizing the connection device.

FIGS. 7 and 8 show an embodiment of the connector device in use on an electronics plug. Particularly, this embodiment may be employed for connection of electrical components on an interface panel, such as a medical device instrument paneling.

In FIG. 7, the electronics connector plug and receptacle are shown to be detached. The plug comprises a coupling ring 75, plug connector end 74, guide 73, and plug body 76. The plug body 76 connects a wire or cable 77 to the coupling ring 75, connector end 74, and the electronic connections therein (not shown). Electric connectors within the plug may be oriented any way, but typically are longitudinally oriented, along the length of the plug. The guide 73 on plug ensures that the plug is properly oriented for connection to the receptacle, and ensures that the plug being inserted fits, so that a proper plug is received by the receptacle. In some embodiments, the receptacle cover 72 may not open unless the plug guide 73 matches a key on the receptacle cover 72. The plug guide 73 matching with a key on the receptacle cover 72 may ensure proper orientation of the plug electrical connections to the electrical contacts 71 to ensure proper connection and operation. In some embodiments, the receptacle cover 72 may be movable along a guide configured which maintains the cover's 72 orientation and prevents its rotation while still allowing the receptacle cover 72 to move along a length of the receptacle. The guide may be, for example, a tab or boss on the receptacle cover that may slide along a longitudinal notch or channel within the receptacle. As mentioned above, the receptacle cover 72 is configured to key with the plug guide 73 to ensure proper orientation of the plug. As such in some embodiments it may be important to maintain the rotational orientation of the receptacle cover 72 as noted above. Moreover, in some embodiments, the longitudinal notch or channel may stop part way down the length of the receptacle, such that the receptacle cover 72 is not depressed to the floor of the receptacle, thereby preserving its keying function.

In this embodiment, the coupling ring 75 may operate as a coupling ring. Coupling ring 75 may freely spin about a longitudinal axis of the plug. Latch tabs 12 extend from an outer surface of the coupling ring 75. On an interior of the rotatable coupling ring 75, ring drive tabs 11 protrude inwardly. Thus, the ring drive tabs 11 and latch tabs 12 are on opposite sides of the coupling ring 75 (acting as the coupling ring). These tabs 11, 12 extend fully around the outer and inner edges of coupling ring 75. Plug drive tabs 31 extend from the connected plug body 76 and are disposed in a circle following the side of the plug body 76. Similarly, on the receptacle 70, the receptacle tabs 21 extend inwardly into the slot defined by the receptacle 70. The receptacle tabs 21 and slot 70 are sized to receive the latch tabs 12 and are radially positioned appropriately.

Upon insertion of the plug into the receptacle slot, and upon application of an inward pushing force to the plug body 76, the plug drive tabs 31 engaging ring drive tabs 11, and push the latch tabs 12 inward. The latch tabs 12 will be automatically oriented as discussed above, and latch tabs 12 will secure to receptacle tabs 21, until a second pushing force again inwardly moves the plug and connected elements, at which point the latch tabs 12 will disengage from the receptacle tabs 21, releasing the plug.

In the embodiment shown, spring 79 of the receptacle body 70 may urge coupling ring 75 into the plug drive tabs 31 to engage the ring drive tabs 11 once the plug begins to be inserted into the receptacle. In another embodiment, a spring or other pressure source (not shown) urges the coupling ring 75 in direction F.

The receptacle is shown aligned with the plug and ready to receive the plug. The receptacle is formed of the receptacle body 70, which defines a slot capable of receiving plug connector end 74. An optional cover 72 lies over the entrance to the slot and allows only a properly shaped plug connector end 74. Electrical contacts 71 extend within the slot to engage with electrical contacts of the plug (not shown), thereby allowing electrical communication between the cable 77, contacts 71, 78 and device to which the receptacle is attached. The electrical contacts 71 are supported by a post located centrally in the receptacle's slot, and in some embodiments, the electrical contacts 71 are arranged around the posts circumference. However, it should be understood that the electrical contacts 71 may be configured in any way within the slot. The electrical contacts 71 extend beyond the receptacle and are formed as contacts 78. Spring 79 may be configured to provide a force against the plug upon its insertion, and may also be used to provide a seal around the plug upon its insertion. Further, in some embodiments, spring 79 may engage with coupling ring 75 upon insertion of the plug connector end 74 and may urge the coupling ring 75 in direction F. In some embodiments, spring 79 may further act to eject the plug connector end 74 once it is disengaged from an engaged position.

FIG. 8 shows a view of the plug and receptacle in an engaged position with the coupling ring connecting to the receptacle tabs. The plug connector end 74 is fully engaged within the receptacle, and electrical contacts extending from the plug body 76 connect to and are in communication with electrical contacts 78. The receptacle cover 72 in this embodiment is slightly in-set from its resting position. An inner cover 80 is axially slidable along the length of the receptacle housing 70. This inner cover 80 is configured to engage at least part of the plug connector end 74. Spring 79 may be connected to the inner cover 80, and may provide an urging force on the inner cover 80 against its inward motion as the plug connector end 74 is inserted. The spring 79 is compressed from its resting position, and in the embodiment shown, is configured to provide a bias on the plug, and in turn the coupling ring 75. The plug, while attached as shown, has more space to be inwardly depressed, allowing it to have a push release, as discussed above. In one embodiment, the electric contacts on either the plug or receptacle may be configured as a male-female connection, or a sliding connection. These types of connections may be configured to allow further movement inward of the plug from the connected state, to allow for the pushing inward to release the plug.

FIGS. 7 and 8 further show the spring loaded cover 72, 79 which provides a number of additional advantages. The cover is configured to be a protective cover that extends to nearly the front of the receptacle 70 to protect the electric contacts 71 therein. The cover may be configured with female keyed patterns to only move when the proper connection end 74 and guide 73 are inserted. Thus, the cover 72 is configured to automatically seal the receptacle and slot and its contents when the receptacle is not mated with a plug. Preferably, the protective cover cannot be depressed by a finger, probe or other object, and only allows entry to a specifically shaped connection end 74 and/or guide 73.

In operation, the connector device has two component sides, the receiving side configured to receive the coupling ring, and the coupling side, having the coupling ring and drive tabs. Typically the plug will be the coupling side, however plug may also be the receiving side, depending on embodiment. Operationally, a user may insert the plug into the receptacle until it is received. In some embodiment, this may be indicated to a user by an audible snap or 'clicking' feeling felt during the insertion. The plug will then be securely received. To remove the plug, the user may again push the plug inwardly, at which point the coupling ring will be released, and the plug can be pulled outwardly away from the receptacle. In some embodiments, this may be indicated by an audible snap or 'clicking' feeling felt during the inward pushing.

Turning now to FIGS. 10-16, another embodiment of an electrical connector shown. The electrical connector shown in FIG. 10 has a first connector body or plug 101 with male contacts 102 enclosed in recesses 103 of an insulative boss 104 (see also FIGS. 11, and 14). The plug boss telescopes into a cavity 106 of a second connector body or receptacle 107 surrounding female contacts 108 (FIGS. 13 and 16) which axially mate with the male contacts 102. The second body 107 has thread 109 beyond a flange 110 for mounting the second body permanently in a panel with a conventional nut (not shown). An annular collar 111 encircles the boss 104 of the first, plug, body and the socket 106 of the second, receptacle body 107 when the two bodies are mated. The collar has internal radial stops 112 which are admitted through passageways 113 in an annular flange 114 on the first body into an annular groove 116 which axially confines the stops and holds the collar rotatably on the first body. The stops limit rotation of the collar to about forty degrees. A coiled spring 117, preferably a round wire of spring metal, also confined in the groove, is anchored at one end inside the collar at one stop 112 and at the other end in a small recess 118 in the groove 116. The spring is biased yieldingly to urge the collar stops 112 always to a normal position in abutment with opposed stops 119 in the groove. In this normal position of the collar, camming tabs 121 on an outside face of the collar are located with respect to the male contacts 102 of the first body such that the tabs 121 and contacts 102 are in matching alignment with like camming tabs 122 on an inner surface of the second body 107, and the female contacts 108 of the second body 107 as will be explained in detail.

With the collar 111 and spring 117 assembled on the plug body 101 the spring may yieldingly hold the collar in the normal position in which the collar camming tabs 121 have the same angular relationship to the male contacts on the plug as the receptacle camming tabs 122 have to the female contact in the receptacle body. To assure that the male contacts are in correct angular alignment during mating engagement, the receptacle cavity 106 has a narrow longitudinal key 123 and a wide key 124 which slide into correspondingly small and large keyways 126 and 127 in the boss 104 of the first, plug, body 101. As a visual aid to the correct angular alignment index marks 128, 129, 131 are embossed and painted on the plug 101, collar 111 and receptacle 107, respectively. The mark on the collar includes an arrowhead 130 indicating the direction in which the collar can be rotated from normal position during the two operations of locking engagement and disengagement of the plug and receptacle.

The operation of locking the plug and receptacle together with mated contacts is effected manually by aligning the index marks 129 and 131 on the collar and receptacle respectively then pushing the two bodies together. At first the collar camming tabs 121 start to slide past the receptacle camming tabs 122 as collar 111 is inserted into receptacle cavity 106. For this purpose each collar camming tab 121 is offset a small angle B, e.g. five degrees, from a central plane through the collar and receptacle. The tabs are pie shaped with opposing points 133 and two camming surfaces 134 flaring away from the point to intersection with a back surface 136. After first sliding engagement the mutual wedging action of the camming surfaces 134 forces the collar to rotate against its spring, allowing the collar tab to slide around the receptacle tab and then spring back with its back surface behind and abutting the back surface of the receptacle tab. In this position the tabs have locked the first, plug body to the second, receptacle body. The spring then reverses rotation of the collar until the faces of the collar stops 112 strike the opposed faces of the plug stops 119 with an audible snap signaling that the plug and receptacle are locked together. Locking is confirmed visually by alignment of the index marks 129 and 131 after the automatic return of the collar to its normal position by the spring.

To disengage the first and second bodies the collar is manually rotated. The circumferential ramp 137 extending from the collar outer face is thereby turned toward tabs 122 and, because it is slanting across the paths of the tabs, the collar 111 is guided away from second body 107 by the force applied between the circumferential ramp of the collar outer face and tab 122 of the second body 107 inner face. The camming face of each ramp 137 is angled away from the adjacent tab so that it cams the collar tab, collar and first body apart and out of engagement. Disengagement is therefore effected without pulling and straining the cord extending from the plug 101, because rotation of the collar is in a plane at right angles to the axis of the plug and cord. Moreover, in some embodiments, a spring within the receptacle (not shown) is provided that may urge the plug away from the receptacle.

The rotating collar and camming tabs of the connector provide automatic locking engagement of the plug and socket without deformation of the plastic, insulative connector bodies or collar. Engagement is indicated positively by an audible snap and by alignment of index marks. The spring allows a rotary disengaging manipulation which is convenient and which places no longitudinal strain on a cord or cable connected to the plug body.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. An electronics connector system comprising:

a plug and a receptacle, the plug having an electronics cable connected to it, the receptacle being configured to receive the plug in a mating configuration;

the plug further comprising:

a plug housing defining a body of the plug;

a connector end extending from the plug housing, a first electric contact being positioned within the connector end and in electronic communication with the cable;

a plurality of plug drive tabs extending from the plug housing, the plug drive tabs having a canted leading face;

a substantially cylindrical coupling ring attached to the plug, the coupling ring being capable of rotational movement, the coupling ring comprising:

a plurality of ring drive tabs having a canted front surface, each canted front surface configured to receive the canted leading face of one of the plurality of plug drive tabs;

a plurality of latch tabs having a canted leading face and a canted trailing face, the plurality of latch tabs being on an opposite end of the coupling ring from the plurality of ring drive tabs;

the receptacle comprising:

a receptacle body defining a slot for receiving the plug, a second electric contact within the slot configured to connect to the first electrical contact of the plug; and a plurality of receptacle tabs connected to the receptacle body, the plurality of receptacle tabs configured to receive the latch tabs of the coupling ring;

the plurality of plug drive tabs, plurality of ring drive tabs, plurality of latch tabs, and plurality of receptacle tabs being configured such that:

wherein upon a first inward motion of the plug towards the receptacle, the plurality of latch tabs are received by the plurality of receptacle tabs, thereby connecting the plug within the receptacle and connecting the first and second electric contacts; and wherein upon a second inward motion of the plug when the plurality of latch tabs are received by the plurality of receptacle tabs the plurality of latch tabs are released from the plurality of receptacle tabs.

2. The electronics connector system of claim 1 wherein the plurality of latch tabs of the coupling ring are each shaped as a parallelogram, having the canted leading face and canted trailing face at a same angle.

3. The electronics connector system of claim 1 wherein the plurality of receptacle tabs each further comprise:

a front portion having two inwardly converging sides joining at a point;

a center portion wherein the two sides are parallel; and a rear portion defining a rear slot configured to receive the trailing end of the latch tab, and a rear guide having a canted face angled to match with the canted trailing face of the latch tab.

4. The electronics connector system of claim 3 wherein the rear slot of each of the plurality of receptacle tabs is formed as an inwardly angled region, having a face angled inwardly from an edge of the tab, the inwardly angled portion comprising a first part of a width of the tab rear portion; and wherein the rear guide comprises a remainder of the width of the tab rear portion, the rear guide having a straight edge extending outwardly from the end of the rear slot, and having an angled face at its end, the angled face extending inwardly and joining to one of the two parallel sides of the center of the latch tab.

5. The electronics connector system of claim 1 wherein the coupling ring drive tabs and the latch tabs are on the same surface of the coupling ring.

6. The electronics connector system of claim 1 wherein the plurality of coupling ring drive tabs and the plurality of latch tabs are on different surfaces of the coupling ring.

7. The electronics connector system of claim 1 wherein the plurality of latch tabs are on an exterior of coupling ring.

8. The electronics connector system of claim 1 further comprising a spring positioned within the slot of the receptacle body; and a cover covering an entrance to the slot, the cover in communication with the spring, and configured to receive the plug against a force of the spring, the spring urging the plug out of the slot.

9. The electronics connector system of claim 8 wherein the cover comprises a female key pattern, and is configured to only allow entrance of the plug having a matching male key pattern.

10. An electronics connector system comprising:

a plug and a receptacle, the plug having an electronics cable connected to it, the receptacle being configured to receive the plug in a mating configuration;

the plug further comprising:

a plug housing defining a body of the plug;

a connector end extending from the plug housing, a first electric contact being positioned within the connector end and in communication with the cable;

a plurality of receiving tabs extending from the plug housing;

the receptacle comprising:

a receptacle body defining a slot for receiving the plug, a second electric contact within the slot configured to connect to the first electrical contact of the plug;

a plurality of receptacle drive tabs extending from the receptacle;

a substantially cylindrical coupling ring attached to the receptacle, the coupling ring being capable of rotational movement, the coupling ring comprising:

a plurality of ring drive tabs having a canted front surface, each canted front surface configured to receive the canted leading face of one of the plurality of receptacle drive tabs;

a plurality of latch tabs having a canted leading face and a canted trailing face, the plurality of latch tabs being on an opposite end of the coupling ring from the plurality of ring drive tabs;

wherein the plurality of latch tabs are configured to be received by the receiving tabs of the plug;

the plurality of receiving tabs, plurality of ring drive tabs, plurality of latch tabs, and plurality of receptacle tabs being configured such that:

wherein upon a first inward motion of the plug towards the receptacle, the plurality of latch tabs are received by the plurality of receiving tabs, thereby connecting the plug within the receptacle and connecting the first and second electric contacts; and wherein upon a second inward motion of the plug when the plurality of latch tabs are received by the plurality of receiving tabs, the plurality of latch tabs are released from the plurality of receiving tabs.

11. The electronics connector system of claim 10 wherein the plurality of latch tabs of the coupling ring are each shaped as a parallelogram, having the canted leading face and canted trailing face at a same angle.

12. The electronics connector system of claim 10 wherein the plurality of receiving tabs each further comprise:

a front portion having two inwardly converging sides joining at a point;

a center portion wherein the two sides are parallel; and a rear portion defining a rear slot configured to receive the trailing end of the latch tab, and a rear guide having a canted face angled to match with the canted trailing face of the latch tab.

13. The electronics connector system of claim 12 wherein the rear slot of each of the plurality of receiving tabs is formed as an inwardly angled region, having a face angled inwardly from an edge of the tab, the inwardly angled portion comprising a first part of a width of the tab rear portion; and wherein the rear guide comprises a remainder of the width of the tab rear portion, the rear guide having a straight edge extending outwardly from the end of the rear slot, and having an angled face at its end, the angled face extending inwardly and joining to one of the two parallel sides of the center of the latch tab.

14. The electronics connector system of claim 10 wherein the coupling ring drive tabs and the latch tabs are on different surfaces of the coupling ring.

15. The electronics connector system of claim 10 further comprising a spring positioned within the slot of the receptacle body; and a cover covering an entrance to the slot, the cover in communication with the spring, and configured to receive the plug against a force of the spring, the spring urging the plug out of the slot.

16. The electronics connector system of claim 15 wherein the cover comprises a female key pattern, and is configured to only allow entrance of the plug having a matching male key pattern.

17. An electrical connector comprising:

first and second tubular connector bodies having telescopingly engagable body portions and axial mating electrical contacts;

an annular collar rotatably held on the first body, and sized to fit within a cavity formed by the second body;

a spring connected to the collar, the ends of the spring being between the first body and the collar and configured to yieldingly resist rotation of the collar relative to the first body;

axially opposed tabs, a first tab on an outer surface of the annular collar, a second tab on an inner surface of the cavity formed by the second body, the tabs having opposing flaring cam surfaces cooperatively producing rotation of the collar relative to the second body as the bodies are telescoped to a mated contact position, the cam surfaces guiding the first tab around the second tab;

wherein the spring is configured to yield as the collar is rotated by the cam tabs during contact mating, and the spring then rotating the first tab to a latching position axially behind the second tab, locking the connector bodies in a mated contact position; and a circumferential ramp extending from an outer surface of the annular collar, the circumferential ramp configured to be guided by the second tab upon manual axial rotation of the collar relative to the second body when mated with the second body, the guiding of the circumferential ramp by the second tab urging the collar out of the receptacle cavity.

18. The electrical connector of claim 17 wherein the first and second tabs are each pie shaped, with an opposing point from which the camming surfaces flare in opposite directions.

19. The electrical connector of claim 18 wherein the first and second tabs each have a back surface remote from their point and extending in the direction of rotation, so that the back surfaces engage each other axially when in latching position.

20. The electrical connector of claim 17 wherein the circumferential ramp is positioned at the same radius as the second tab, the ramp slanting across the path of the second tab upon rotation of the collar to cam the collar tab, collar, and first body apart and out of engagement with the second body.

* * * * *